US010532245B1

(12) United States Patent
Rector

(10) Patent No.: US 10,532,245 B1
(45) Date of Patent: Jan. 14, 2020

(54) ORTHOTIC FOOT REST FOR A PEDALING MACHINE

(71) Applicant: Michael A. Rector, Newbury Park, CA (US)

(72) Inventor: Michael A. Rector, Newbury Park, CA (US)

( * ) Notice: Subject to any disclaimer, the term of this patent is extended or adjusted under 35 U.S.C. 154(b) by 0 days.

(21) Appl. No.: 16/508,992

(22) Filed: Jul. 11, 2019

(51) Int. Cl.
*A63B 21/00* (2006.01)
*A63B 22/06* (2006.01)
*A63B 22/00* (2006.01)

(52) U.S. Cl.
CPC ..... *A63B 21/4034* (2015.10); *A63B 22/0605* (2013.01); *A63B 2022/0094* (2013.01); *A63B 2022/0652* (2013.01); *A63B 2225/096* (2013.01)

(58) Field of Classification Search
CPC ..... A63B 21/4011; A63B 21/4013; A63B 21/4015; A63B 21/4033–4034; A63B 2022/0611; A63B 22/0046; Y10T 74/2172; B62M 3/08; B62M 3/083; B62M 3/086; A61H 1/005; A61H 1/02; A61H 1/0214; A61H 1/0237; A61H 1/0266; A61H 2001/0203; A61H 2001/0207; A61H 2001/0211; A61H 2201/164; A61H 2201/1642; A61H 2205/10; A61H 2205/106; A61H 2205/12; A61H 2205/125; A61F 5/01; A61F 5/0111; A61F 5/0113; A61F 5/0116; A61F 5/0127
USPC ..... 128/882; 602/5, 23, 27–29, 36
See application file for complete search history.

(56) References Cited

U.S. PATENT DOCUMENTS 3,472,508 A * 10/1969 Baker ..... A63B 21/0004 482/79
4,200,005 A 4/1980 Mohr
4,271,605 A * 6/1981 Raczka ..... A61F 13/067 36/14
4,846,156 A * 7/1989 Kopnicky ..... A61H 1/0214 601/36
4,856,211 A * 8/1989 Phillips ..... A43B 5/14 36/131
4,928,673 A * 5/1990 Heneger ..... A61H 1/0214 482/60
5,033,736 A * 7/1991 Hirschfeld ..... A61H 1/0214 482/57
5,493,794 A * 2/1996 McKenzie ..... A63C 13/001 36/122

(Continued)

*Primary Examiner* — Andrew S Lo
*Assistant Examiner* — Kathleen Vermillera
(74) *Attorney, Agent, or Firm* — Louis Ventre, Jr.

(57) ABSTRACT

An orthotic foot rest is a pedal for a pedaling machine. It includes a platform, an instep-strap and/or a heel strap and a width-adjusting assembly. The platform holds a person's foot that is either bare or in a shoe. When present, the instep-strap forms an arch extending up above the platform such that the person's foot, with or without a shoe, can be slipped under the arch and rest on the platform. When present, the heel strap encircles the person's foot. A width-adjusting assembly adjusts the tension against the side of the foot to secure it in place on the platform. Paired-strap-posts define a u-shaped-slot between them that is wide enough to receive the strap and restrain a cam buckle that is slidably attachable on each of the straps. A release strap enables a person to pull on the release-strap to remove the buckle from the u-shaped-slot.

17 Claims, 9 Drawing Sheets

(56) References Cited

U.S. PATENT DOCUMENTS

| | | | | |
|---|---|---|---|---|
| 5,833,575 | A * | 11/1998 | Holslag | A63B 21/015 482/51 |
| 6,730,003 | B1 | 5/2004 | Phillips | |
| 8,065,933 | B2 | 11/2011 | Coderre | |
| 9,003,921 | B2 | 4/2015 | Weagle | |
| 10,272,287 | B1 | 4/2019 | Rector | |
| 2002/0188239 | A1 * | 12/2002 | Turtzo | A61F 5/0111 602/27 |
| 2006/0048599 | A1 | 3/2006 | Wald | |
| 2018/0290008 | A1 * | 10/2018 | Avila | A63B 21/4015 |

* cited by examiner

ORTHOTIC FOOT REST FOR A PEDALING MACHINE

TECHNICAL FIELD

In the field of machine elements, a foot engaging unit attachable as a pedal to a crank arm rotating about an axis.

BACKGROUND ART

Post mountable rotary exercise devices are available to enable rotary pedaling for hand, foot and leg muscle rehabilitation. One particular such device is disclosed in U.S. Pat. No. 10,272,287, issued 30 Apr. 2019, which teaches the use of bicycle pedals for foot operation of the disclosed rotary apparatus. The present invention has primary use on this kind of stationary device and has potential secondary uses for mobility on a bicycle.

Pedal platforms of various designs have been proposed, such as U.S. Pat. No. 9,003,921, issued 14 Apr. 2015, which discloses circumferential plates in roughly the same shape as a typical bicycle pedal. The circumferential plates bolt to the top and bottom of the bicycle pedal to toughen the pedal against ground impacts.

A slip-on platform that holds a shoe within an instep strap is taught in U.S. Pat. No. 8,065,933, issued 29 Nov. 2011, which discloses an ergonomic bicycle pedal with removable platform. This pedal platform enables a person to slip into an instep strap held by the pedal platform. The pedal platform underside has a front hook and a rear hook to engage with the pedal.

A foot-size pedaling platform with a heel cup is disclosed in U.S. Pat. No. 6,730,003, issued 4 May 2005. This patent teaches a pedal assembly for a stationary bicycle having a foot receiving platform with an axle aligned with the heel of the user's foot when positioned on the platform. Hook and loop fasteners attached to the bottom of the shoe and the top of the pedaling platform hold the shoe in place.

SUMMARY OF INVENTION

An orthotic foot rest is a pedal for a pedaling machine. The orthotic foot rest includes a platform, an instep-strap and a width-adjusting assembly. The platform holds a person's foot that is either bare or in a shoe. The instep-strap forms an arch extending up above the platform such that the person's foot, with or without a shoe, can be slipped under the arch and rest on the platform. The instep-strap is preferably secured on the bottom-face of the platform. Preferably, a bearing-post is attached to the instep-strap. The bearing-post works in conjunction with an instep-slide that is also attached to the bottom-face of the platform. The instep-slide and bearing post enables the instep-strap to be adjusted when the bearing-post slidably engages against the instep-slide to move the instep-strap toward or away from the toe-end of the platform to accommodate the person's foot when the person's foot is on the platform.

The width-adjusting assembly sits on the platform adjacent to the arch and is a mechanism for adjusting the tension against the side of the foot to secure it in place on the platform. The width-adjusting assembly has two nearby stanchions that rise from the platform. There is a first-connector spanning the top of the stanchions and a second-connector spanning the bottom of the stanchions close to the platform. A compliant material surrounds the second-connector to serve as a soft and flexible component that comfortably butts up against the side of the person's foot. For, example, the compliant material may be a flexible tube. A compliance-recess is formed between the bottom of the compliant material and the platform that is wide enough to permit the instep-strap to be routed through the compliance-recess. The instep-strap is then routed upward and inward around the compliant material and then atop the first-connector where it can be pulled outward so that the instep-strap is taut against the person's foot. Once taut, the instep-strap is restrained on the platform.

The orthotic foot rest may include: paired-strap-posts that define a u-shaped-slot between them that is wide enough to receive the strap; and a buckle that is slidably attachable on each of the straps. When the buckle is snugged up against the paired-strap posts, it restrains the strap from loosening within the u-shaped-slot. There may also be a first-receiving-post attached to the buckle to which a release-strap may be removably snapped-on. When snapped-on, the release strap enables a person to pull on the release-strap to remove the buckle from the u-shaped-slot. The paired-strap-posts may be used in conjunction with a tightening-post to provide additional tightening capability for each strap. For example, a tightening-post may be used for additional tightening of the instep-strap.

The one or more straps may also include a heel-strap that essentially is routed around the person's foot. The heel-strap is restrained at the toe-end of the platform, routed around the toe end to the heel-end of the platform, and then routed around a person's heel to return to the toe-end of the platform where it is made taut against the person's heel and secured. As with the instep-strap, a tightening-post may be used to provide additional tightening of the heel-strap. When a heel strap is present, there may also be a back-strap at the heel end that can be used to pull the heel-strap away from the person's foot when the person's foot is on, entering or exiting the platform. The back-strap may also include a snap-on fixture that attaches to a first-receiving-post extending below the bottom-face of the platform. The snap-on fixture enables removable attachment of the back-strap to the platform.

Strap-posts may be included in the orthotic foot rest to restrain or guide the heel-strap around the toe end of the platform.

Each of the two stanchions of the width-adjusting assembly is preferably slidably adjustable within its own transit aperture defined through the platform. Each such transit aperture would enable movement of the stanchion so as to adjust the width available to receive the person's foot on the platform.

The orthotic foot rest may further include a knob that threadably engages with one of the stanchions so that it locks the stanchion in place within its transit aperture when the knob is tightened on the stanchion against the bottom-face of the platform.

The orthotic foot rest alternatively includes a platform configured to secure a person's foot on the top-face using one or more straps, and has a connection to a pedaling machine on the bottom-face so that the platform can operate as a pedal. The straps include a heel strap that is restrained at the toe-end of the platform routed around where the person's toes would be to the heel-end of the platform, then routed around where a person's heel would be and then routed back to the toe end where it is secured. Optionally, a back-strap is located above the heel-strap so that pulling the back-strap rearward pulls the heel-strap away from the person's foot when the person's foot is on, entering, or exiting the platform. Optionally, a snap-on fixture attached to the back-strap, and a first-receiving-post is secured on the bottom-face of the platform. The first-receiving-post engages with the snap-on fixture to removably attach the back-strap to the snap-on fixture. Optionally, a width-adjusting assembly as described above is included in this alternative.

Technical Problem

A person with foot or leg issues is often faced with difficulty in foot placement muscle control, and foot retention on the pedal of a rotary exercise machine, like a stationary bicycle, or even on a regular bicycle. An orthotic foot rest for a pedaling machine is needed that enables attachment of human foot in or out of a shoe and can be used to pedal a stationary or mobile exercise device in a manner that can accommodate a varied shoe or foot size, can quickly release when disengagement is required, and is easy to use for the physically challenged.

Many of the existing technologies utilizing a pedaling platform require special shoes to work. There is a need for a platform that can accommodate and secure a person's bare foot or an ordinary shoe without any special shoe or foot attachments.

While some therapeutic pedals may provide a heel cup and instep strap to restrain the foot, these do not hold the foot securely under higher use forces.

Solution to Problem

The solution is an orthotic foot rest for a pedaling machine that can attach to an existing bicycle pedal or replace the existing bicycle pedal.

The solution is an orthotic foot rest for a pedaling machine that enables attachment of human foot that is in or out of a shoe.

The solution is an orthotic foot rest for a pedaling machine that is usable to pedal a stationary or mobile exercise device.

The solution is an orthotic foot rest for a pedaling machine that is width adjustable for a varied bare foot or one that is shod in a wide variety of footwear.

The solution is an orthotic foot rest for a pedaling machine in a manner that has quick release features so that a physically impaired person can easily insert or remove a foot from the platform.

The solution is an orthotic foot rest for a pedaling machine that incorporates ease of use features for physically impaired individuals.

Advantageous Effects of Invention

The primary orthotic foot rest embodiment uses resilient material that engages with the side of the person's foot when the strap over the instep of the foot is tightened.

An alternative orthotic foot rest embodiment uses strapping that encircles the person's foot from toe to toe and around the heel. The encircling strap keeps the person's foot on the platform and may be used in conjunction with the instep strap.

Optional embodiments of the orthotic foot rest use open slots on the platform to restrain the straps, provide quick release of the straps; and multiple straps extending from the heel area facilitate insertion and removal of the person's foot.

BRIEF DESCRIPTION OF DRAWINGS

The drawings illustrate preferred embodiments of the orthotic foot rest for a pedaling machine according to the disclosure. The reference numbers in the drawings are used consistently throughout. New reference numbers in FIG. 2 are given the 200 series numbers. Similarly, new reference numbers in each succeeding drawing are given a corresponding series number beginning with the figure number.

DESCRIPTION OF EMBODIMENTS

In the following description, reference is made to the accompanying drawings, which form a part hereof and which illustrate several embodiments of the present invention. The drawings and the preferred embodiments of the invention are presented with the understanding that the present invention is susceptible of embodiments in many different forms and, therefore, other embodiments may be utilized and structural, and operational changes may be made, without departing from the scope of the present invention.

Figure 1:
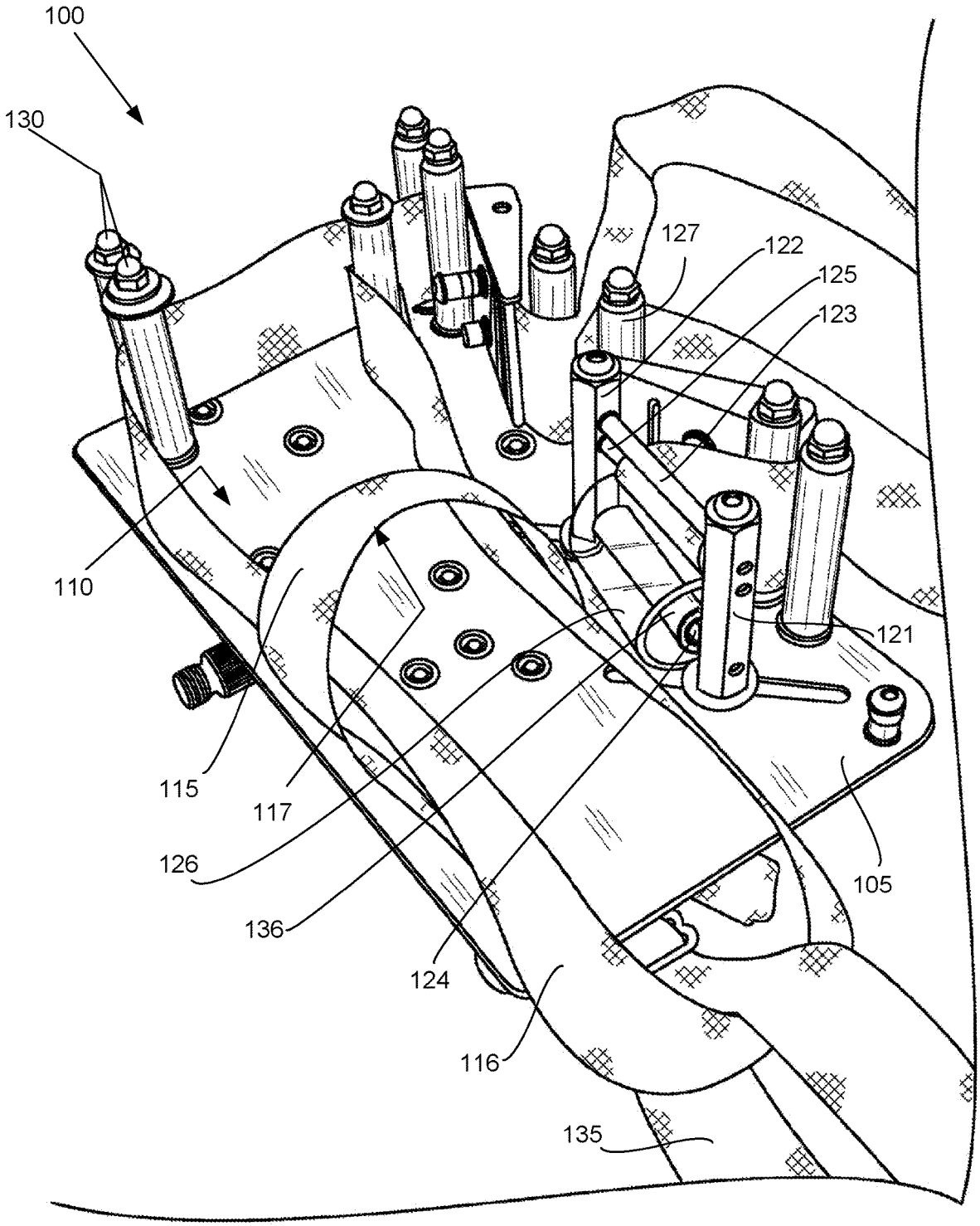
FIG. 1 is a top perspective view of a preferred embodiment of the orthotic foot rest.
Figure 11:
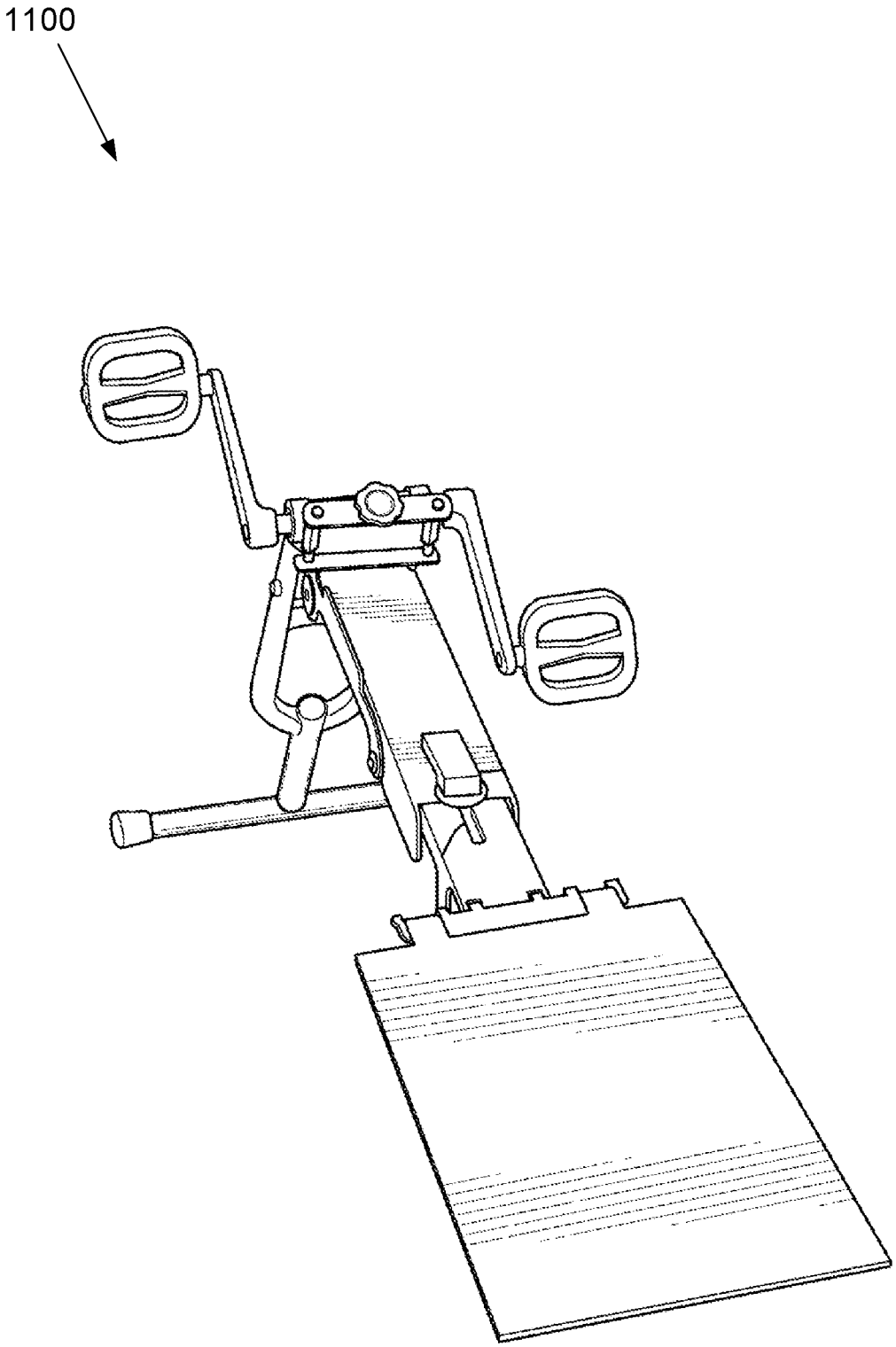
FIG. 11 is a perspective view of one type of pedaling machine upon which the orthotic foot rest may be used.

FIG. 1 is a top perspective view of a preferred embodiment of the orthotic foot rest (100) illustrating the components thereof. The orthotic foot rest (100) is for use on a pedaling machine, one type of which is illustrated in FIG. 11. This pedaling machine (1100) has the usual pedals found on a bicycle. The orthotic foot rest (100) essentially provides a platform for a person's foot as a substitute for the usual pedal, or as an attachment to the usual pedal. This illustrated version of the pedaling machine (1100) is a stationary pedaling machine often used for rehabilitation. Exercise bicycles are another version (not illustrated), which are representative of stationary bicycles. The orthotic foot rest (100) may also be used on a regular riding bicycle.

The orthotic foot rest (100) includes a platform (105), an instep-strap (115), and a width-adjusting assembly (600).

Figure 10:
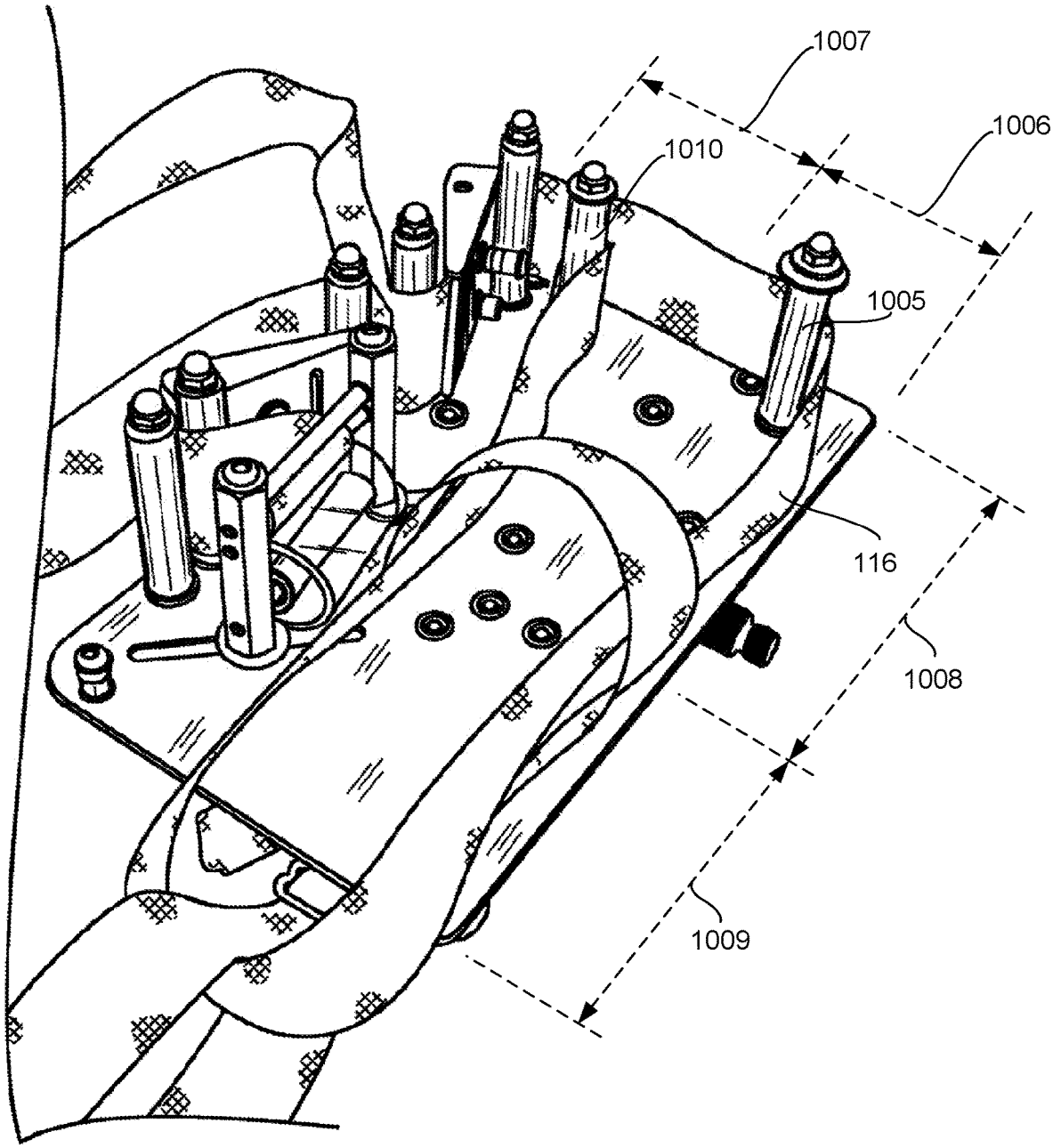
FIG. 10 is top perspective view of an alternative embodiment of the orthotic foot rest illustrating the common directional nomenclature.

FIG. 1 illustrates most of the parts and FIG. 10 illustrates the directional nomenclature. The platform (105) is defined by an in-side (1006), an out-side (1007), a toe-end (1008), a heel-end (1009), a top-face (110), and a bottom-face (215).

The in-side (1006) of the platform (105) is a designation for that part of the width of the platform (105) where the person's foot rests when on the platform (105). The in-side (1006) is approximately half of the platform (105) that is closest to the midsagittal plane or midline of a person's body when the person's foot is on the platform (105). It is designated in this way because, depending on the foot, the in-side (1006) of the platform (105) is either the right-side or the left-side of a person's foot. For a person's left foot, the in-side (1006) of the platform (105) would be to the person's right and for a person's right foot, the in-side (1006) of the platform would be to the person's left.

The out-side (1007) is also a designation for that part of the width of the platform (105) opposite to where the person's foot rests when on the platform (105). The out-side is approximately half of the platform (105) that is farthest or lateral of the midsagittal plane of a person's body when the person's foot is on the platform (105).

The toe-end (1008) of the platform (105) is a designation for that part of the length of the platform (105) closest to the toes of the person's foot when the person's foot is on the platform (105). It is about half of the platform opposite the heel-end (1009) of the platform (105).

The heel-end (1009) of the platform (105) is a designation for that part of the length of the platform (105) closest to the heel of the person's foot when the person's foot is on the platform (105). It is about half of the platform opposite the toe-end (1008) of the platform (105).

The top-face (110) is the surface of the platform (105) where the person's foot would be located when the person's foot is on the platform (105). Thus, the top-face (110) is where the person's foot rests when in use. The top-face (110) is configured to secure a person's foot thereon using one or more straps, including for example, the instep-strap (115) or the heel strap (116).

Figure 2:
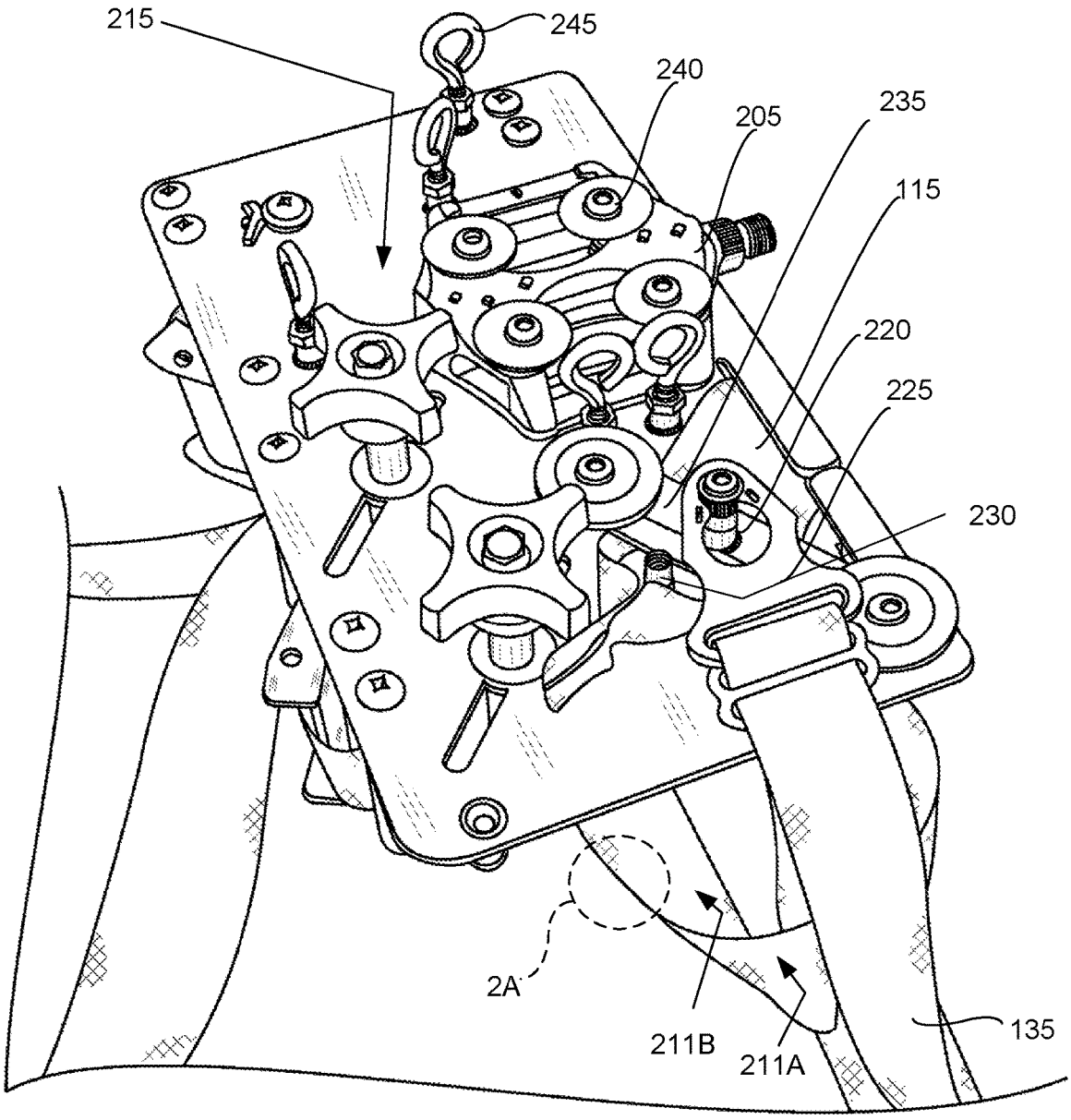
FIG. 2 is a bottom perspective view thereof.
Figure 2A:
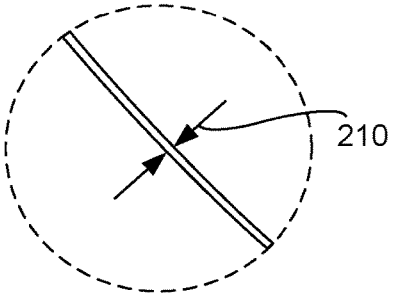
FIG. 2A is a partial view showing the thickness of a strap identified in FIG. 1.
Figure 3:
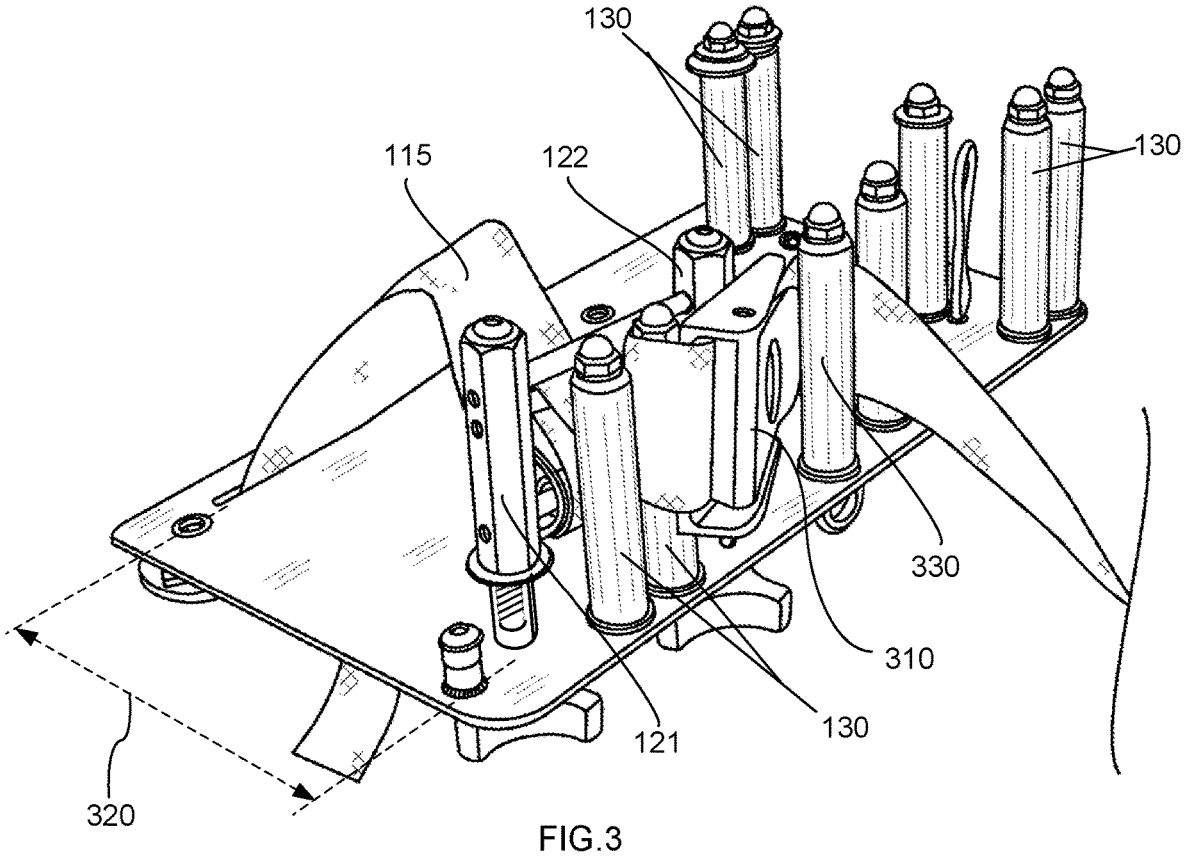
FIG. 3 is a top perspective view from the outside of the orthotic foot rest of FIG. 1.
Figure 4:
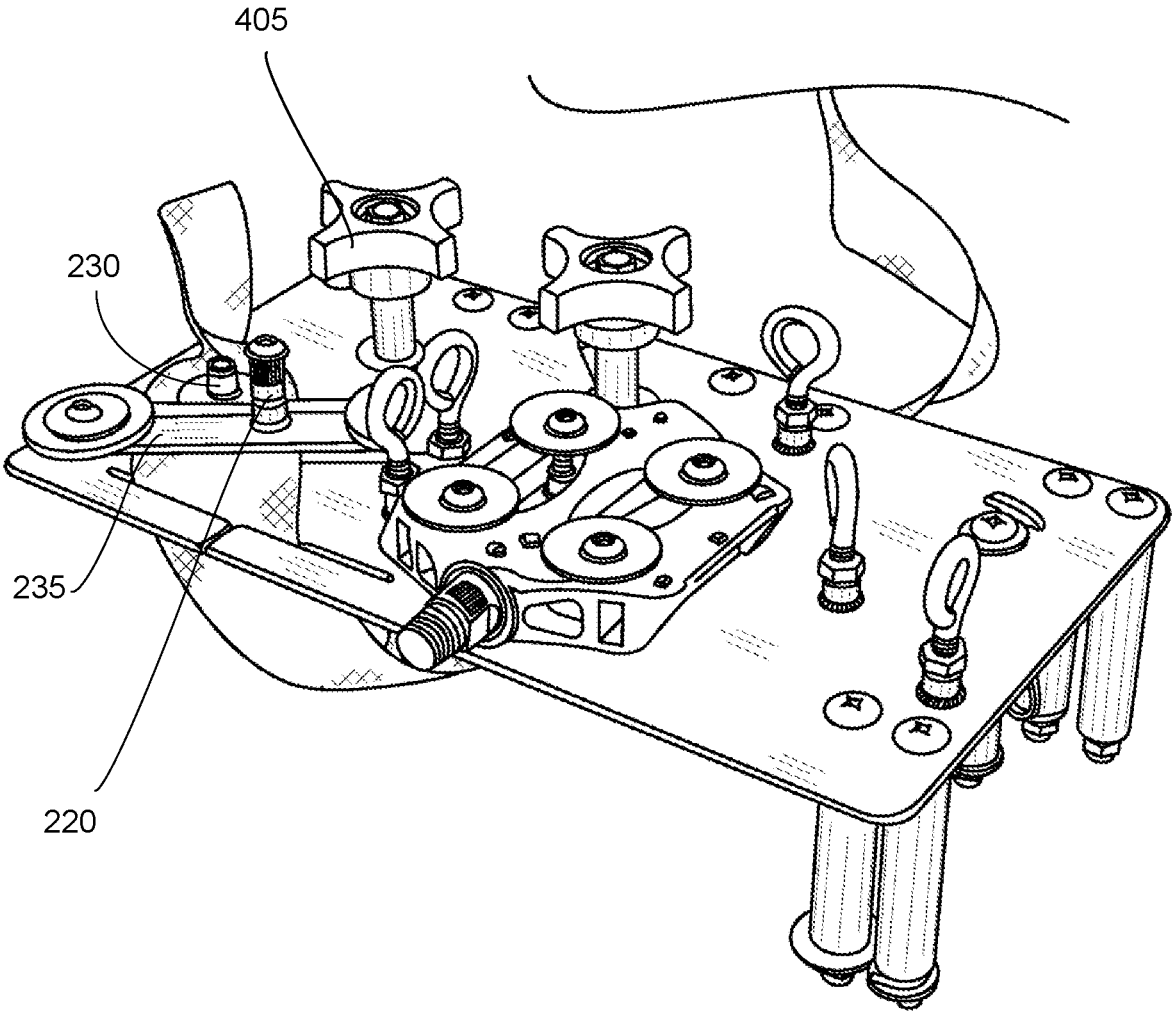
FIG. 4 is a is a bottom perspective view from the inside of the orthotic foot rest of FIG. 1
Figure 5:
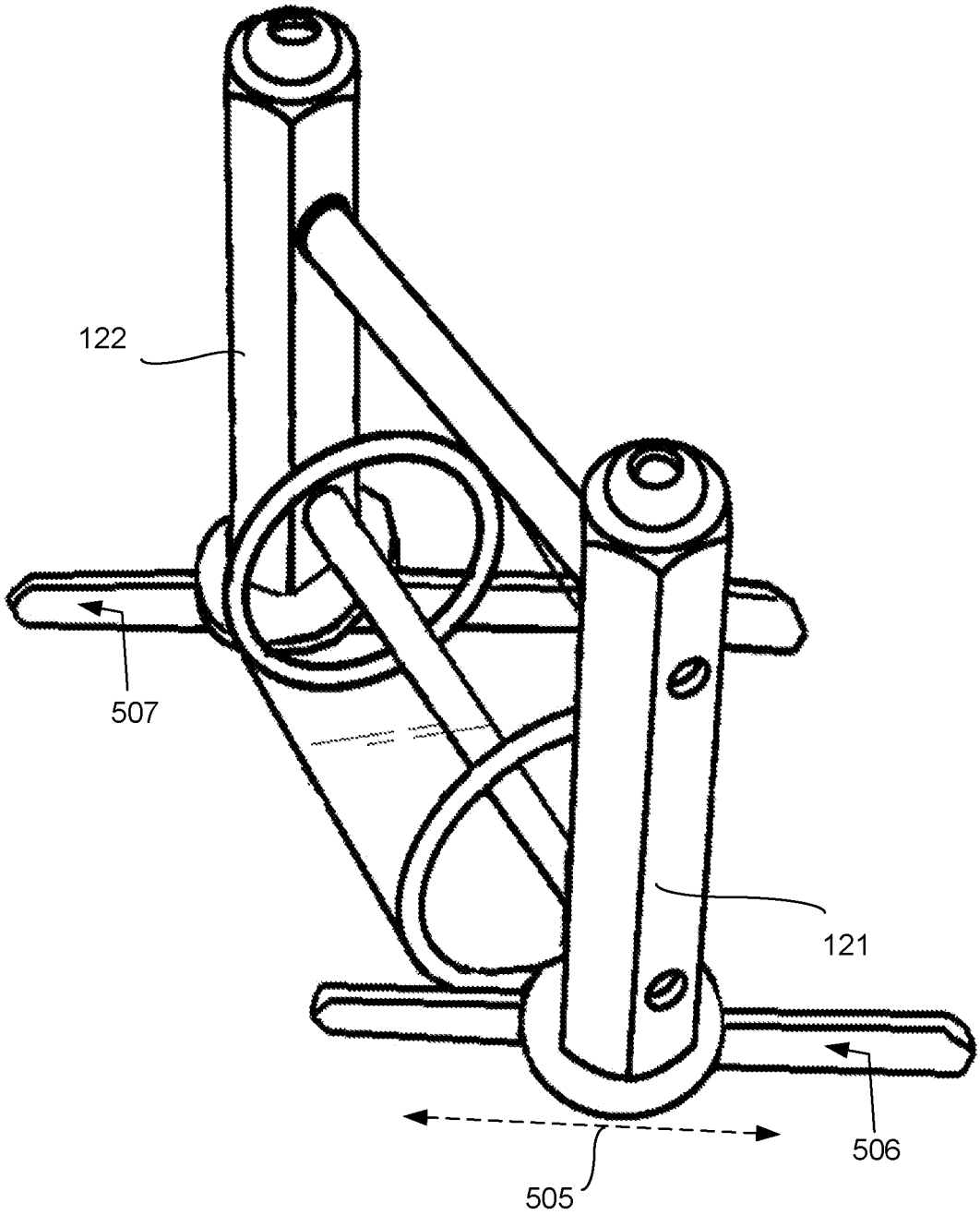
FIG. 5 is a perspective view of a width-adjusting mechanism within a first-transit-aperture and a second-transit-aperture.

The bottom-face (215) is the surface of the platform (105) opposite to the top-face (110). The bottom-face (215) configured for connection to the pedaling machine (1100) as a pedal (205), as shown in FIG. 2. This pedal (205) may be supplied with the orthotic foot rest (100), or it may simply be the pedal existing on the pedaling machine (1100) and attached to the orthotic foot rest (100) by, for example, at least one bolt (240). Four such bolts are as shown in FIG. 2.

Each of the one or more straps used in the orthotic foot rest (100) preferably has a strap-thickness (210) and two opposing planar sides (211A) and (211B). While the strap-thickness for different straps may differ, the strap-thickness (210) is preferably the same strap-thickness for each of the one or more straps used.

The instep-strap (115) is preferably secured to the out-side (1007) of the platform (105), either on the top-face (110) or the bottom-face (215). The instep-strap (115) rises up and forms an arch (117) sufficient for a person to slide their foot under the arch (117) and rest their foot predominantly on the in-side (1006), top-face (110) of the platform (105). The instep-strap (115) preferably has sufficient stiffness to hold the arch (117) in an elevated position. Whether or not such stiffness is present, the instep-strap (115) may simply be lifted up should it be pushed downward to rest on the top-face (110). Thus, normally, the instep-strap is configured to form an arch (117) extending up from the top-face (110) of the platform (105) starting on the out-side (1007) of the platform (105) and the arch (117) ending on the top-face (110) of the platform (105) on the in-side (1006) of the platform (105) such that the person's foot can be slipped under the arch (117).

Figure 6:
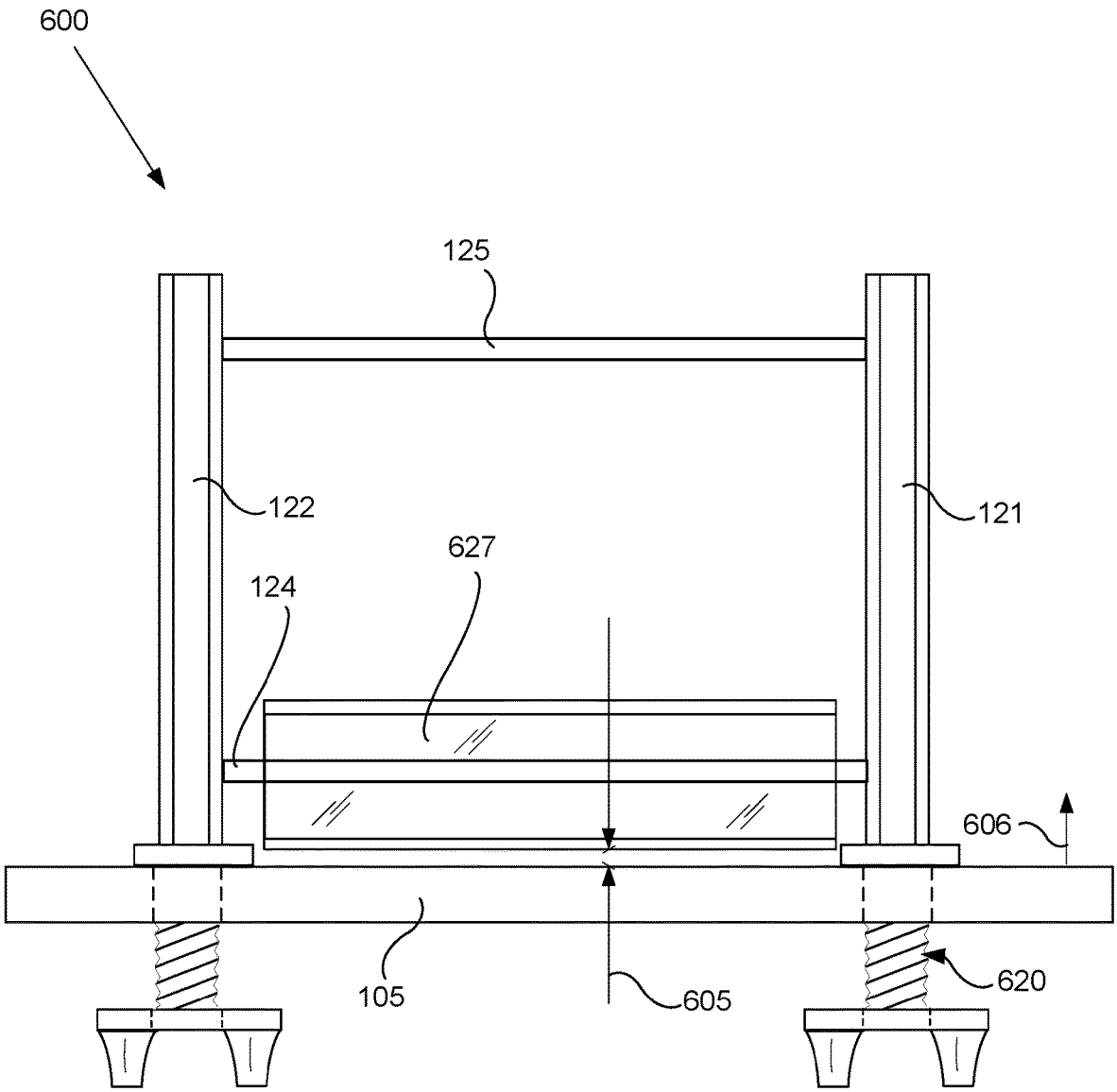
FIG. 6 is a side elevation view of an alternative width-adjusting mechanism.
Figure 7:
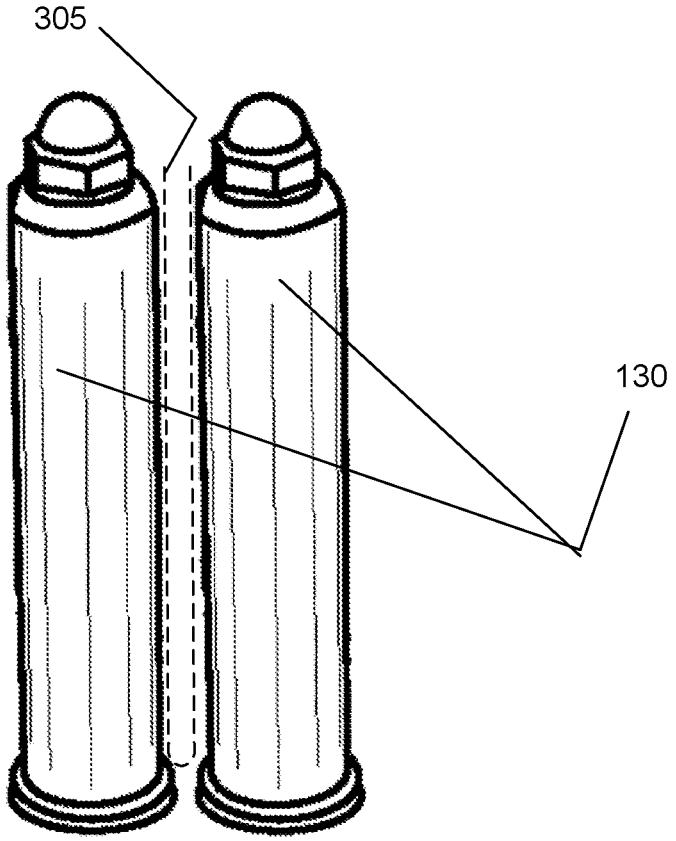
FIG. 7 is a perspective view of paired-strap-posts forming a u-shaped-slot between the posts.

The width-adjusting assembly (600) is located on the top-face (110) of the platform (105) on the out-side (1007). A preferred embodiment of the width-adjusting assembly (600) with a first-connector (125) and a second-connector (124) is shown in isolation in FIG. 6. An alternative preferred embodiment with a third-connector (123) is shown integrated into the platform in FIG. 1. The width-adjusting assembly (600) is secured to the out-side (1007) of the platform (105), adjacent to the arch (117).

The width-adjusting assembly (600) includes two stanchions: a first-stanchion (121) and a second-stanchion (122). These two stanchions rise above the top-face (110) of the platform (105). The width-adjusting assembly (600) further includes a first-connector (125) extending between and supported by the two stanchions. The width-adjusting assembly (600) further includes a second-connector (124) below the first-connector (125). The second-connector (124) also extends between and is supported by the first-stanchion (121) and a second-stanchion (122). Additional connectors may be used.

Preferably, the width-adjusting assembly (600) is configured so that the first-stanchion (121) and the second-stanchion (122) are slidably adjustable (505) within one or more transit apertures, to wit, first-transit-aperture (506) or the second-transit-aperture (507), defined through the platform (105). This configuration enables movement of the first-stanchion (121) or the second-stanchion (122) in the first-transit-aperture (506) or the second-transit-aperture (507), respectively, adjusts a width (320) available to receive the person's foot on the platform (105). When any of the one or more transit apertures are present, there is preferably also included in the orthotic foot rest (100) a knob (405) for each of the one or more transit apertures, to wit, the first-transit-aperture (506) and the second-transit-aperture (507). Each knob (405) is configured to threadably engage (620) with the first-stanchion or the second-stanchion from under the platform (105). The knob (405) is configured to fix the first-stanchion or the second-stanchion in position within either the first-transit-aperture (506) or the second-transit-aperture (507), respectively, by tightening the knob (405) against the bottom-face (215) of the platform (105).

Preferably, an embodiment of the width-adjusting assembly (600) includes a compliant material (126) surrounding the second-connector (124). The compliant material (126) may be a flexible tube (627). The compliant material (126) defines a compliance-recess (605) between the compliant material (126) and the top-face (110) of the platform (105). The compliance-recess (605) is where the instep-strap (115) is routed so that when it is pulled taut, it snugs the width-adjusting assembly (600) up against the person's foot when the person's foot is on the platform (105). The compliance-recess (605) may be present simply by pushing up the flexible tube (627) from a resting position on the top-face (110) of the platform (105). Thus, the compliance-recess (605) is configured to accept therewithin the instep-strap (115). The orthotic foot rest may further include a roller tube (136) that surrounds the second-connector (124) and is internal to the compliant material (126). The roller tube (136) has the second-connector (124) passing through it whereby rotational friction is reduced when the instep-strap (115) moves in contact with the compliant material (126).

Thus, the instep-strap (115) is configured to be routed under the compliant material (126), through the compliance-recess (605), and upward (606) from the top-face (110) of the platform (105) in contact with the compliant material (126) and then to be routed between the compliant material (126) and the first-connector (125) and then to be routed over the first-connector (125). In this configuration, the instep-strap (115) can be pulled taut snugging up against the person's foot and then secured to the platform. Securing can be on the top-face (110) or the bottom-face (215). Securing may be accomplished using, for example, any of a plurality of posts, such as one of the paired-strap-posts (130) when present, or the third-strap post (330), when present. Thus, the instep-strap (115) is configured to be restrained on the platform (105) once pulled taut against the person's foot.

Thus, the compliant material (126) is configured to be compressible when the instep-strap (115) is pulled taut over the first-connector (125) and against the person's foot when the person's foot is under the arch (117) formed by the instep-strap (115).

Figure 8:
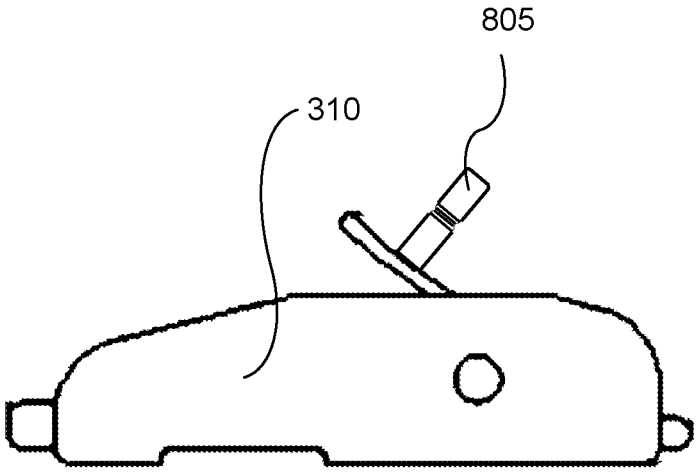
FIG. 8 is a side elevation view of a buckle with a first-receiving-post.
Figure 9:
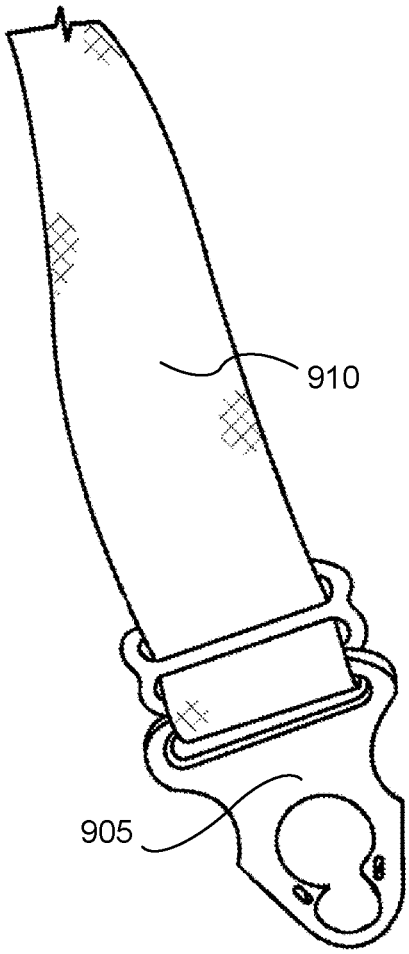
FIG. 9 is a top perspective view of a first-release-strap with a first-snap-on fixture.

The orthotic foot rest (100) may include paired-strap-posts (130) and a buckle (310) that slides to any position on any of the plurality of straps and can be locked in place such as by using a buckle (310) with a cam lock as shown in FIG. 8. The paired-strap-posts define a u-shaped-slot (305) therebetween. The u-shaped-slot (305) is configured to receive the strap-thickness (210) such that when the buckle (310) is locked in place on a taut strap, the strap slid into the U-shaped-slot (305), the buckle (310) will wedge against one of the paired-strap-posts (130) and be secured in a taut state. Thus, the buckle (310) is configured to be restrained against the paired-strap-posts (130) when any of the one or more straps is within the u-shaped-slot (305) defined by the paired-strap-posts (130). The buckle (310) is preferably slidably attachable on any of the one or more straps.

The orthotic foot rest (100) may also include a tightening-post (127) extending from the top-face (110) of the platform (105). The tightening-post is configured so that additional tightening of the instep-strap (115) can be obtained when the buckle (310) is placed against the tightening-post. The tightening-post (127) may be used alone or in combination with the paired-strap-posts (130), as shown in FIG. 1.

The plurality of strap-posts may further include a loop-ended post (245) that may be useful to confine the path of any of the one or more straps used on the orthotic foot rest (100).

The orthotic foot rest (100) may further include a first-receiving-post (805) attached to the buckle (310) and a first-release-strap (910) equipped with a first-snap-on fixture (905) that mates with the first-receiving-post (805). The first-receiving-post (805) is used to attach the first-release-strap (910) to the buckle (310) using the first-snap-on fixture (905). Once attached, the first-release-strap (910) can simply be pulled on to easily remove the buckle from the u-shaped-slot (305) thus releasing the tension the strap. When used on the instep-strap, pulling the first-release-strap (910) releases the tension in the instep strap (115) and thus releases the person's foot from the platform (105). A receiving-post attached to the buckle (310) and a release strap with a snap-on fixture combination may be used with any of the one or more straps to which the buckle (310) is attached.

Thus, the first-snap-on fixture (905) is configured to removably attach to the first-receiving-post (805). The first-snap-on fixture, when removably attached to the first-receiving-post (805), is configured to enable a person to pull on the first-release-strap (905) to remove the buckle (310) from the u-shaped-slot (305).

The one or more straps of the orthotic foot rest (100) may include a heel-strap (116). The heel-strap (116) essentially encircles the person's foot from toe to heel. Thus, the heel-strap (116) is configured with a length enabling the heel-strap (116) to be restrained at the toe-end (1008) of the platform (105) on the out-side (1007) of the platform (105), routed to the in-side (1006) of the platform (105) at the toe-end (1008) of the platform (105), routed from the toe-end (1008) of the platform (105) at the in-side (1006) of the platform (105) to the heel-end (1009) of the platform (105) on the in-side (1006), then routed to the out-side (1007) of the platform (105), then routed from the heel-end (1009) of the platform (105) on the out-side (1007) to the toe-end (1008) of the platform (105) on the out-side (1007), and finally secured at the toe-end (1008) of the platform (105) on the out-side (1007) of the platform (105).

The encircling route for the heel-strap (116) may be altered. For example, the heel-strap (116) may be routed first across the toe-end (1008) of the platform (105), and then from the toe-end (1008) of the platform (105) on the out-side (1007) of the platform (105) to the heel-end (1009) of the platform (105) on the out-side (1007), and thence routed to the in-side (1006) of the platform (105), and then routed from the heel-end (1009) of the platform (105) on the in-side (1006) to the toe-end (1008) of the platform (105) on the in-side (1006), and then secured at the toe-end (1008) of the platform (105).

When a heel-strap (116) is present, the orthotic foot rest (100) may also include a back-strap (135). The back-strap (135) is configured with a length sufficient to form a loop routed above and below the heel-strap (116) so that pulling the back-strap (135) rearward, pulls the heel-strap (116) away from the person's foot when the person's foot is on, entering, or exiting the platform (105). FIG. 2 additionally shows the back-strap (135) secured on the bottom-face (215) using a second-receiving-post (220) and a second-snap-on fixture (225). The second-receiving-post (220) extends from the instep-slide (235), which is attached to the platform (105) on the bottom-face (215).

The orthotic foot rest (100) may include a plurality of strap-posts that may be used as an aid in securing any of the one or more straps. Such strap-posts optionally include a first-strap-post (1005) extending from the top-face (110) of the platform (105) at the toe-end (1008) on the in-side (1006) of the platform (105), and a second-strap-post (1010) extending from the top-face (110) of the platform (105) at the toe-end (1008) on the out-side (1007) of the platform (105). In this regard, the heel-strap (116), when present, may be further configured to be restrained by the second-strap-post (1010), routed from the second-strap-post (1010) to extend to the heel-end (1009) of the platform (105), routed from the heel-end (1009) of the platform (105) on the out-side (1007) and thence routed to the in-side (1006) of the platform (105), and routed from the heel-end (1009) of the platform (105) on the in-side (1006) to the first-strap-post (1005) and secured at the toe-end (1008) of the platform (105).

The instep-strap (115) is optionally secured on the bottom-face (215) of the platform (105) and is routed at the in-side (1006) of the platform (105) from the top-face (110) of the platform (105) to the bottom-face (215) of the platform (105). In this optional configuration, the orthotic foot rest (100) also preferably includes a bearing-post (230) attached to the instep-strap (115). The bearing-post (230) is secured on the bottom-face (215) by the bearing-post (230), which slides against an instep-slide (235) attached to the bottom-face (215) of the platform (105). This sliding ability enables the instep-strap (115) to adjust position, and be secured from movement that releases tension on the instep-strap (115). The instep-strap (115) is routed under the instep-slide (235) in a configuration where the bearing-post (230) slidably engages against the instep-slide (235) to move the instep-strap (115) toward or away from the toe-end (1008) of the platform (105) to accommodate the person's foot when the person's foot is on the platform (105).

In an alternative embodiment, the orthotic foot rest (100) for a pedaling machine (1100) includes a platform (105), and a heel-strap (116), but no instep-strap (115). In this embodiment the platform (105) has an in-side (1006), an out-side (1007), a toe-end (1008), a heel-end (1009), a top-face (110), and a bottom-face (215). The top-face (110) is configured to secure a person's foot thereon using one or more straps, and the bottom-face (215) is configured for connection to the pedaling machine (1100) as a pedal (205). Each of the one or more straps has a strap-thickness (210) and two opposing planar sides (211A) and (211B). The heel-strap (116) has with a length enabling the heel-strap (116) to be restrained at the toe-end (1008) of the platform (105) on the out-side (1007) of the platform (105); routed from the toe-end (1008) of the platform (105) at the out-side (1007) of the platform (105) to the heel-end (1009) of the platform (105) on the out-side (1007) and thence routed to the in-side (1006) of the platform (105); routed from the heel-end (1009) of the platform (105) on the in-side (1006) to the toe-end (1008) of the platform (105) on the in-side (1006); and secured at the toe-end (1008) of the platform (105) on the in-side (1006) of the platform (105).

This alternative embodiment of the orthotic foot rest (100) may include a back-strap (135). The back-strap (135) is configured with a length sufficient to loop below and above the heel-strap (116) so that pulling the back-strap (135) rearward, pulls the heel-strap (116) away from the person's foot when the person's foot is on, entering, or exiting the platform (105). The back-strap (135) may further include a second-receiving-post (220) and a second-snap-on fixture (225). The second-receiving-post (220) extends from the instep-slide (235), which is attached to the platform (105) on the bottom-face (215).

This alternative embodiment of the orthotic foot rest (100) may include a width-adjusting assembly (600). The width-adjusting assembly (600) secured to the out-side (1007) of the platform (105) and includes two stanchions, to wit, a first-stanchion (121) and a second-stanchion (122) that rise above the top-face (110) of the platform (105), a first-connector (125) extending between and supported by the first-stanchion (121) and a second-stanchion (122), a second-connector (124) below the first-connector (125), the second-connector (124) extending between and supported by the first-stanchion (121) and a second-stanchion (122), and a compliant material (126) surrounding the second-connector (124). Alternately a roller tube (136) has the second-connector (124) passing through it whereby rotational friction is reduced when the instep-strap (115) moves in contact with the compliant material (126).

Alternately a third-connector (123) spanning between and restrained by a first-stanchion (121) and a second-stanchion (122) and located immediately above the first-connector (125) provides a bearing surface in conjunction with first-connector (125) where the instep-strap (115) can be restrained. Thus, in this embodiment, the third-connector (123) is located above the first-connector. The third-connector is configured so that the instep-strap can pass between the first-connector (125) and the third-connector (123) and so that the instep strap (115) can be restrained against the first-connector (125) and the third-connector (123).

This alternative embodiment of the orthotic foot rest (100) may include a width-adjusting assembly (600), as is described above.

The above-described embodiments including the drawings are examples of the invention and merely provide illustrations of the orthotic foot rest for a pedaling machine. Other embodiments will be obvious to those skilled in the art. Thus, the scope of the invention is determined by the appended claims and their legal equivalents rather than by the examples given.

INDUSTRIAL APPLICABILITY

The invention has application to the rehabilitation and exercise equipment industry.

What is claimed is:

1. An orthotic foot rest for a pedaling machine, the orthotic foot rest comprising:

a platform, the platform comprising an in-side, an out-side, a toe-end, a heel-end, a top-face, and a bottom-face, the top-face configured to secure a person's foot thereon using one or more straps, and the bottom-face configured for connection to the pedaling machine as a pedal, each of the one or more straps comprising a strap-thickness and two opposing planar sides; the one or more straps comprising an instep-strap;

the instep-strap secured to the out-side of the platform, the instep-strap configured to form an arch extending up from the top-face of the platform starting on the out-side of the platform and the arch ending on the top-face of the platform on the in-side of the platform such that the person's foot can be slipped under the arch;

a width-adjusting assembly, the width-adjusting assembly secured to the out-side of the platform adjacent to the arch, the width-adjusting assembly comprising:

two stanchions rising above the top-face of the platform;

a first-connector extending between and supported by the two stanchions;

a second-connector below the first-connector, the second-connector extending between and supported by the two stanchions;

a compliant material surrounding the second-connector;

the compliant material defining a compliance-recess between the compliant material and the top-face of the platform; and the compliance-recess configured to accept therewithin the instep-strap;

the instep-strap further configured to be routed under the compliant material, through the compliance-recess, and upward from the top-face of the platform in contact with the compliant material and then to be routed between the compliant material and the first-connector and then to be routed over the first-connector;

the compliant material configured to be compressible when the instep-strap is pulled taut over the first-connector and against the person's foot when the person's foot is under the arch formed by the instep-strap; and the instep-strap further configured to be restrained on the platform.

2. The orthotic foot rest of claim 1, further comprising:

paired-strap-posts that define a u-shaped-slot therebetween, the u-shaped-slot configured to receive the strap-thickness; and a buckle, the buckle slidably attachable on each of the one or more straps.

3. The orthotic foot rest of claim 2, wherein the buckle is configured to be restrained against the paired-strap-posts when any of the one or more straps is within the u-shaped-slot defined by the paired-strap-posts; and the orthotic foot rest further comprising:

a first-receiving-post attached to the buckle; and a first-release-strap comprising a first-snap-on fixture, the first-snap-on fixture configured to removably attach to the first-receiving-post, the first-snap-on fixture, when removably attached to the first-receiving-post, configured to enable a person to pull on the first-release-strap to remove the buckle from the u-shaped-slot.

4. The orthotic foot rest of claim 1, wherein the one or more straps further comprise a heel-strap, the heel-strap configured with a length enabling the heel-strap to be:

restrained at the toe-end of the platform on the out-side of the platform;

routed to the in-side of the platform at the toe-end of the platform;

routed from the toe-end of the platform at the in-side of the platform to the heel-end of the platform on the in-side and thence routed to the out-side of the platform;

routed from the heel-end of the platform on the out-side to the toe-end of the platform on the out-side; and secured at the toe-end of the platform on the out-side of the platform.

5. The orthotic foot rest of claim 1, further comprising a plurality of strap-posts, the plurality of strap-posts comprising:

a first-strap-post extending from the top-face of the platform at the toe-end on the in-side of the platform; and a second-strap-post extending from the top-face of the platform at the toe-end on the out-side of the platform;

wherein the one or more straps further comprise a heel-strap, the heel-strap configured with a length enabling the heel-strap to be:

restrained by the second-strap-post;

routed from the second-strap-post to extend to the heel-end of the platform;

routed from the heel-end of the platform on the out-side and thence routed to the in-side of the platform; and routed from the heel-end of the platform on the in-side to the first-strap-post and secured at the toe-end of the platform.

6. The orthotic foot rest of claim 1, wherein:

the two stanchions comprise a first-stanchion and a second-stanchion;

the first-stanchion and the second-stanchion are configured to be slidably adjustable within one or more transit apertures defined through the platform; and movement of the first-stanchion or the second-stanchion in the one or more transit apertures adjusts a width available to receive the person's foot on the platform.

7. The orthotic foot rest of claim 6, wherein the one or more transit apertures consist of a first-transit-aperture and a second-transit-aperture, wherein the first-stanchion is configured to ride within the first-transit-aperture and the second-stanchion is configured to ride within the second-transit-aperture, the orthotic foot rest further comprising: a knob, the knob configured to threadably engage with the first-stanchion or the second-stanchion, the knob further configured to fix the first-stanchion or the second-stanchion in position within either the first-transit-aperture or the second-transit-aperture, respectively, by tightening the knob against the bottom-face of the platform.

8. The orthotic foot rest of claim 1, wherein the compliant material is a flexible tube.

9. The orthotic foot rest of claim 8, further comprising a roller tube that surrounds the second-connector and is internal to the compliant material.

10. The orthotic foot rest of claim 1, wherein the instep-strap is secured on the bottom-face of the platform and is routed at the in-side of the platform from the top-face of the platform to the bottom-face of the platform, the orthotic foot rest further comprising:

a bearing-post attached to the instep-strap; and an instep-slide attached to the bottom-face of the platform such that the instep-strap can be adjusted under the instep-slide in a configuration where the bearing-post slidably engages against the instep-slide to move the instep-strap toward or away from the toe-end of the platform to accommodate the person's foot when the person's foot is on the platform.

11. The orthotic foot rest of claim 1, wherein the one or more straps further comprise a heel-strap, the heel-strap configured with a length that enables the heel-strap to be:

restrained at the toe-end of the platform on the out-side of the platform;

routed to the in-side of the platform at the toe-end of the platform;

routed from the toe-end of the platform at the in-side of the platform to the heel-end of the platform on the in-side and thence routed to the out-side of the platform;

routed from the heel-end of the platform on the out-side to the toe-end of the platform on the out-side; and secured at the toe-end of the platform on the out-side of the platform; and the orthotic foot rest further comprising a back-strap, the back-strap configured with a length sufficient to form a loop routed above and below the heel-strap so that pulling the back-strap rearward pulls the heel-strap away from the person's foot when the person's foot is on, entering or exiting the platform.

12. The orthotic foot rest of claim 11, further comprising:

a snap-on fixture attached to the back-strap;

a receiving-post extending below the bottom-face of the platform; and the receiving-post configured to engage with the snap-on fixture to removably attach the back-strap to the receiving-post.

13. The orthotic foot rest of claim 1, further comprising a plurality of strap-posts, the plurality of strap-posts comprising:

a first-strap-post extending from the top-face of the platform at the toe-end on the in-side of the platform; and a second-strap-post extending from the top-face of the platform at the toe-end on the out-side of the platform;

wherein the one or more straps further comprise a heel-strap, the heel-strap configured with a length enabling the heel-strap to be:

restrained by the second-strap-post;

routed from the second-strap-post to extend to the heel-end of the platform;

routed from the heel-end of the platform on the out-side and thence routed to the in-side of the platform; and routed from the heel-end of the platform on the in-side to the first-strap-post; and the orthotic foot rest further comprising a back-strap, the back-strap configured with a length sufficient to loop above and below the heel-strap so that pulling the back-strap rearward pulls the heel-strap away from the person's foot when the person's foot is on, entering, or exiting the platform.

14. The orthotic foot rest of claim 1, further comprising:

paired-strap-posts that define a u-shaped-slot therebetween, the u-shaped-slot configured to receive the strap-thickness;

a buckle, the buckle slidably attachable on each of the one or more straps; and a tightening-post extending from the top-face of the platform, the tightening-post configured so that additional tightening of the instep-strap can be obtained when the buckle is placed against the tightening-post.

15. The orthotic foot rest of claim 1, wherein the one or more straps further comprise a heel-strap, the heel-strap configured with a length enabling the heel-strap to be:

restrained at the toe-end of the platform on the out-side of the platform;

routed from the toe-end of the platform at the out-side of the platform to the heel-end of the platform on the out-side and thence routed to the in-side of the platform;

routed from the heel-end of the platform on the in-side to the toe-end of the platform on the in-side; and secured at the toe-end of the platform; and the orthotic foot rest further comprising:

a buckle, the buckle slidably attachable on the one or more straps; and a tightening-post extending from the top-face of the platform, the tightening-post configured so that additional tightening of the heel-strap can be obtained when the buckle is placed against the tightening-post.

16. The orthotic foot rest of claim 1, further comprising a third-connector above the first-connector, the third-connector configured so that the instep-strap can pass between the first-connector and the third-connector and so that the instep-strap can be restrained against the first-connector and the third-connector.

17. An orthotic foot rest for a pedaling machine, the orthotic foot rest comprising:

a platform, the platform comprising an in-side, an out-side, a toe-end, a heel-end, a top-face, and a bottom-face, the top-face configured to secure a person's foot thereon using one or more straps, and the bottom-face configured for connection to the pedaling machine as a pedal, each of the one or more straps comprising a strap-thickness and two opposing planar sides; the one or more straps comprising a heel-strap;

the heel-strap configured with a length enabling the heel-strap to be:

restrained at the toe-end of the platform on the out-side of the platform;

routed from the toe-end of the platform at the out-side of the platform to the heel-end of the platform on the out-side and thence routed to the in-side of the platform;

routed from the heel-end of the platform on the in-side to the toe-end of the platform on the in-side;

secured at the toe-end of the platform on the in-side of the platform;

a snap-on fixture attached to a back-strap;

a receiving-post secured to the bottom-face of the platform;

the receiving-post configured to engage with the snap-on fixture to removably attach the back-strap to the receiving-post;

a width-adjusting assembly, the width-adjusting assembly secured to the out-side of the platform, the width-adjusting assembly comprising:

two stanchions rising above the top-face of the platform;

a first-connector extending between and supported by the two stanchions;

a second-connector below the first-connector, the second-connector extending between and supported by the two stanchions; and a compliant material surrounding the second-connector.

* * * * *